United States Patent [19]

Zatkulak et al.

[11] Patent Number: 4,919,869

[45] Date of Patent: Apr. 24, 1990

[54] APPARATUS FOR AND PROCESS OF TREATING SHRINKABLE FIBERS

[75] Inventors: Tony D. Zatkulak, Midlothian; David J. Rodini, Richmond; James D. Hodge, Midlothian, all of Va.

[73] Assignee: E. I. Du Pont de Nemours and Company, Wilmington, Del.

[21] Appl. No.: 326,443

[22] Filed: Mar. 22, 1989

Related U.S. Application Data

[63] Continuation-in-part of Ser. No. 55,394, May 29, 1987, abandoned.

[51] Int. Cl.[5] ..... D01F 6/60; D06P 3/24; D06B 3/04

[52] U.S. Cl. ..... 264/78; 264/48; 264/129; 264/131; 264/168; 264/234; 264/280; 264/342 R; 264/342 RE; 264/343; 264/345; 264/DIG. 71; 8/148; 8/149.3; 8/151.2; 8/925; 68/5 D; 427/377; 427/378; 427/434.6

[58] Field of Search ..... 68/5 C, 5 R, 5 D; 8/148, 149.3, 151, 150, 151.2, 152, 925; 264/342 RE, 168, 78, 48, 129, 131, 280, 343, 345, 342 R, DIG 71; 427/377, 378, 434.6

[56] References Cited

U.S. PATENT DOCUMENTS

| | | | |
|---|---|---|---|
| 3,063,966 | 11/1962 | Kwolek et al. | 528/348 |
| 3,094,511 | 6/1963 | Hill, Jr. et al. | 528/336 |
| 3,287,324 | 11/1966 | Sweeny | 528/348 |
| 3,343,187 | 9/1967 | Schiffer | 8/149.3 |
| 3,457,029 | 7/1969 | Drago | 8/149.3 |
| 3,471,248 | 10/1969 | Schaeuble | 8/925 |
| 3,644,969 | 2/1972 | Guillermin et al. | 8/148 |
| 3,713,769 | 1/1973 | Beal et al. | 8/925 |
| 3,751,778 | 8/1973 | Gosjean et al. | 8/148 |
| 3,888,821 | 6/1975 | Milford | 264/184 |
| 3,953,167 | 4/1976 | Minemura et al. | 8/925 |
| 4,161,054 | 7/1979 | Clermont | 26/21 |
| 4,571,765 | 2/1986 | Okada et al. | 8/149.3 |

FOREIGN PATENT DOCUMENTS 1438067 6/1976 United Kingdom .

OTHER PUBLICATIONS

"Continuous Tow Dyeing Range—Serracant System"; Brochure, Tunel Secocab Compact, S. A. Serracant, Sabadell, Spain.

*Primary Examiner*—Hubert C. Lorin

[57] ABSTRACT

A process for diffusing and subliming water-soluble and water-insoluble materials into never-dried, shrinkable aromatic polyamide fibers, using steam heated at certain controlled temperatures, within a specially designed treatment chamber and a process and apparatus for treating a tow of shrinkable material.

19 Claims, 2 Drawing Sheets

7
1
6
6
28
19
21
23
20
22
24
25
30
26
A
A
20
29
22
18
17
28
27
22
1
1
24
22
29
22'
22
23
22'
20
21
22'
18
17

APPARATUS FOR AND PROCESS OF TREATING SHRINKABLE FIBERS

This is a continuation-in-part of application Ser. No. 07/055,394 filed May 29, 1987, now abandoned.

BACKGROUND OF THE INVENTION

FIELD OF THE INVENTION

The field of art to which this invention pertains is shrinkable materials and, more particularly, it is directed to processes for treating a tow of shrinkable fibers.

Specifically such invention is a process of treating a tow of aromatic polyamide fibers by moving the tow in folds through a chamber having a plug section which is operatively connected by a restricted opening to a treatment section and by heating the tow with steam in the treatment section.

Sufficient steam migrates into the plug section to cause shrinkage of the tow in this section. The cross-sectional area of the tow is substantially the same as the cross-sectional area of the entrance opening of the plug section as it enters such opening but it has a smaller cross-sectional area, due to shrinkage, as it leaves this section and moves through the restricted entrance opening of the treatment section. By making this opening smaller so that the cross-sectional area of the shrunken tow as it enters such restricted opening is substantially the same as the cross-sectional area of such opening, loss of steam through the entrance opening of the plug section is minimized.

More specifically, this invention is a process for dyeing a fiber structure of poly(meta-phenylene isophthalamide) fibers with a water-soluble dye by heating the amorphous, shrinkable fibers, as spun and prior to drying, with steam, in a specifically designed chamber, at a temperature from about 110° C. to about 140° C., and preferably at about 120° C., for a time sufficient to diffuse substantially all of the dye into the minute pores in the fibers, throughout the fiber structure.

An organic water-insoluble material, such as an ultraviolet light screener, may also be mixed with the water-soluble dye and padded onto the water-swollen fibers prior to heating. While the dye is effectively diffused into the fiber structure at temperatures between 110° C. and 140° C., such structure must also be heated with steam at a sublimation temperature below the glass transition temperature of the fibers in order to sublime the screener into the pores of the fibers. The fibers are then, preferably, further heated with steam at about 165° C. for a time sufficient to collapse the pores in the fibers and lock the dye therein. At this temperature the fibers also will crystallize and the fiber structure is thereby stabilized against progressive laundry shrinkage.

DESCRIPTION OF THE RELATED ART

Aromatic polyamide fibers are well known to the art. They have high tensile strength, are flame and heat resistant, possess good flex life, and have high melting points which make them particularly suited to be formed into fabrics usable as protective clothing, and for many other uses.

It further is known that while aromatic polyamide fibers possess many desired properties as manufactured they also require, for given uses, that various steps be taken to improve a property or properties of the fibers to meet a specific end use. As an example, various additives such as dyes, ultraviolet light screeners, flame retardants, antistatic agents or water repellents, may be incorporated into the fibers during basic manufacture or in subsequent processing steps to improve their performance levels.

This invention is specifically directed to aromatic polyamide fibers of a poly(meta-phenylene isophthalamide) polymer, hereinafter referred to as "MPD-I fibers". Such fibers, which are described in greater detail in U.S. Pat. No. 3,287,324 to Sweeny, for example, possess many useful properties. It is well known to the art, however, that these fibers are difficult to dye.

Various techniques have evolved to solve this dyeing problem. One such solution is mire fully described in copending application Ser. No. 910,941, filed Sept. 26, 1986, now U.S. Pat. No. 4,755,355 which patent is incorporated herein by reference.

The invention of this copending application solves various problems found in the prior art by surprisingly finding that by heating as-spun, never-dried, water-swollen, or still moist to the touch, MPD-I fibers with steam, heated within certain temperature ranges, it is possible effectively to dye the fibers. Specifically, it has been found that such fibers may be dyed, using a water-soluble dye, by heating the fibers with steam heated at a temperature from about 110° C. to 140° C. for a time sufficient to diffuse the dye into the pores of the fibers.

It further has been found that after this diffusion step has taken place that such fibers may be subsequently heated, again with steam, at a temperature of about 165° C. to collapse the fibers and lock the dye in place. This latter step will also crystallize the fibers and stabilize them against progressive laundry shrinkage.

In practicing the invention just described, the treatment or dyeing of the fibers is accomplished by moving such fibers, in tow form, through a treatment chamber having one or more treatment sections. It has been found difficult to maintain the steam temperatures at the critical limits required, within these sections, since the steam tends to migrate toward the chamber openings. This problem is partially solved, as described in the above-mentioned copending application Ser. No. 910,941, by supplying the tow to the chamber in folds. While this is an effective means of controlling the loss of steam, the problem still remains troublesome, particularly in the case of shrinkable tows because their cross-sections vary due to shrinkage as they move through the chamber. The instant invention not only solves this shrinkage problem but also provides an improved process for practicing the invention of copending application Ser. No. 910,941.

Accordingly, this invention provides improved processes for treating aromatic polyamide fibers, using steam to dye a water-swollen fiber structure of poly(-meta-phenylene isophthalamide) fibers with a water-soluble dye, before they are dried, or to add an organic water-insoluble material to the fibers, either mixed with the dye or alone, and to lock the dye and/or other impregnate into the pores of the fibers. This is accomplished by maintaining the steam wi thin certain critical temperature ranges (e.g., 110° C. to 140° C.) in a specially designed chamber to diffuse the dye into the fiber pores and up to 165° C. to sublime the water-insoluble material into such pores. At this latter temperature the dye is also locked into the fibers, while stabilizing such fibers against progressive laundry shrinkage.

SUMMARY OF THE INVENTION

Briefly described, this invention is a process for treating synthetic fibers including the steps of:

moving a tow of shrinkable fibers in folds through a treatment section having an entrance opening and an exit opening smaller than the entrance opening and heating the tow with steam in the treatment section.

In this process, the tow has a cross-sectional area substantially the same as the cross-sectional area of the entrance opening as it enters that opening whereby loss of steam through such opening is minimized and a smaller cross-sectional area as it leaves the section, due to shrinkage. This latter area is only slightly smaller, or substantially the same size as, the exit opening whereby loss of steam is minimized through this opening as well.

In a more specific embodiment, this invention is a process of treating a tow of shrinkable fibers which includes the steps of:

moving the tow in folds through a plug section operatively connected by a restricted opening to a treatment section, with the plug section having an entrance opening larger than the restricted opening of the treatment section, and heating the tow with steam in the treatment section.

Sufficient steam migrates through the restricted opening from the treatment section to the plug section to cause shrinkage of the tow in the plug section. The tow has a cross-sectional area substantially the same as the cross-sectional area of the entrance opening of the plug section as it moves through this opening and has a smaller cross-sectional area as it leaves the plug section and moves through the entrance opening of the treatment section, due to shrinkage. The cross-sectional area of the shrunken tow as it enters the smaller entrance opening of the treatment section is substantially the same as the cross-sectional area of this opening and, along with the tow moving in folds in the plug section, this substantially prevents loss of steam through the entrance opening of the plug section.

Preferably the tow is an amorphous aromatic polyamide and, more specifically the aromatic polyamide is poly (meta-phenylene isophthalamide). Such tow has a second order glass transition temperature in steam of above about 150° C.

The processes just described further may include the steps of padding a water-soluble dye onto the tow prior to the treatment section and heating the tow with steam in the treatment section at a temperature of from about 110° C. to 140° C. for a time sufficient to diffuse the dye into pores in the fibers of the tow. Still further steps may include moving the tow into a second treatment section and heating the tow with steam in this section at a temperature above its glass temperature from about 150° C. to 165° C. for a time sufficient to collapse the pores and lock the dye within the fibers and to crystallize such fibers and thereby stabilize the tow against progressive laundry shrinkage.

In still another embodiment, the process of this invention includes the steps of:

moving the tow through first and second treatment sections, contacting the fibers of the tow prior to the first treatment section with an aqueous mixture containing a water-soluble dye and an organic water-insoluble material which sublimes in steam at a temperature below the glass transition temperature of the fibers, heating the water-swollen fibers with steam in the first treatment section at a temperature from about 110° C. to 140° C. for a time sufficient to diffuse substantially all of the water-soluble dye into the pores of such fibers throughout the fiber structure, heating the water-swollen fibers with steam at a sublimation temperature below the glass transition temperature of the fibers for a time sufficient to sublime the water-insoluble material into the pores of such fibers throughout the fiber structure, and thereafter heating the water-swollen fibers with steam in the second treatment section at a temperature above the glass transition temperature of the fibers for a time sufficient to collapse the pores and irreversibly lock the dye within the fibers and to stabilize the fibers against progressive laundry shrinkage.

In this latter process, the fibers preferably are heated with steam at a sublimation temperature from about 110° C. to 150° C. The water-insoluble material may be an ultraviolet light screener and the water-insoluble material may be a disperse dye. Further the fibers may be heated with steam in the second treatment section at a temperature of about 165° C. to stabilize the fibers.

In more precise detail, this invention is a process of treating a tow of shrinkable material including the steps of:

moving the tow at a first speed through an entrance opening at one end of a funnel-shaped, fold-forming section having converging walls which define a discharge opening at the other end of the section, with the entrance opening being larger than the discharge opening;

moving the folded tow through a restricted entrance opening of a chamber defined by walls and having a plurality of sections including a plug section and first and second steam treatment sections, with the chamber being connected to the discharge opening of the fold-forming section and the chamber entrance opening being smaller than the entrance opening of fold-forming section, and the chamber further having a tow exit opening wherein the dual action of the converging walls of the fold-forming section and the tow pushing through the restricted entrance opening of the chamber forms a plurality of folds in the tow, wherein steam is introduced into the second steam treatment section, which is positioned between the entrance and exit openings of the chamber, whereby such steam flows, in one direction into and through the second steam treatment section and into the first steam treatment section, and from there into the plug section and toward the entrance opening of the fold-forming section and in the other direction into and through the second steam treatment section and toward the exit opening of the chamber, engaging the folds of the tow as it is moved in the fold-forming section and through the entrance opening of the chamber with pins on an endless chain moving at a second speed slower than the first speed moving the tow in folds through the plug section at the second speed and wherein the plurality of folds of the tow are in substantial contact with the walls of chamber defining the plug section during a substantial portion of their movement through this section whereby to help substantially eliminate loss of steam through the entrance opening of the fold-forming section and wherein the steam flowing into this plug section shrinks the tow so that it has a cross-sectional area smaller than that at which it entered this section moving the tow in folds through a restricted entrance opening of the first treatment section, with such entrance opening being smaller than the entrance opening of the chamber moving the tow through the first treatment section at the second speed and wherein the plurality of folds of the tow, as shrunken in the first plug section, are substantially in contact with the walls defining the first treatment section through much of their movement through this section whereby to further help prevent any loss of steam flowing though this section and through the plug section from escaping through the entrance opening of the fold-forming section.

In such process, preferably, the chain engages two tows, one on each side, and moves them at the second speed through the chamber and the entrance opening of the chamber is connected to discharge opening of the fold-forming section by a tapered surface. A tapered surface also preferably connects the plug section to the entrance opening of the treatment section.

In another embodiment of this invention, suitable apparatus is provided for carrying out the above-described processes.

Finally, in its broadest terms, this invention matches the shrinking profile of the tow with the profile of the chamber walls, during treatment of such tow in the chamber.

DESCRIPTION OF THE PREFERRED EMBODIMENTS

Figure 1:
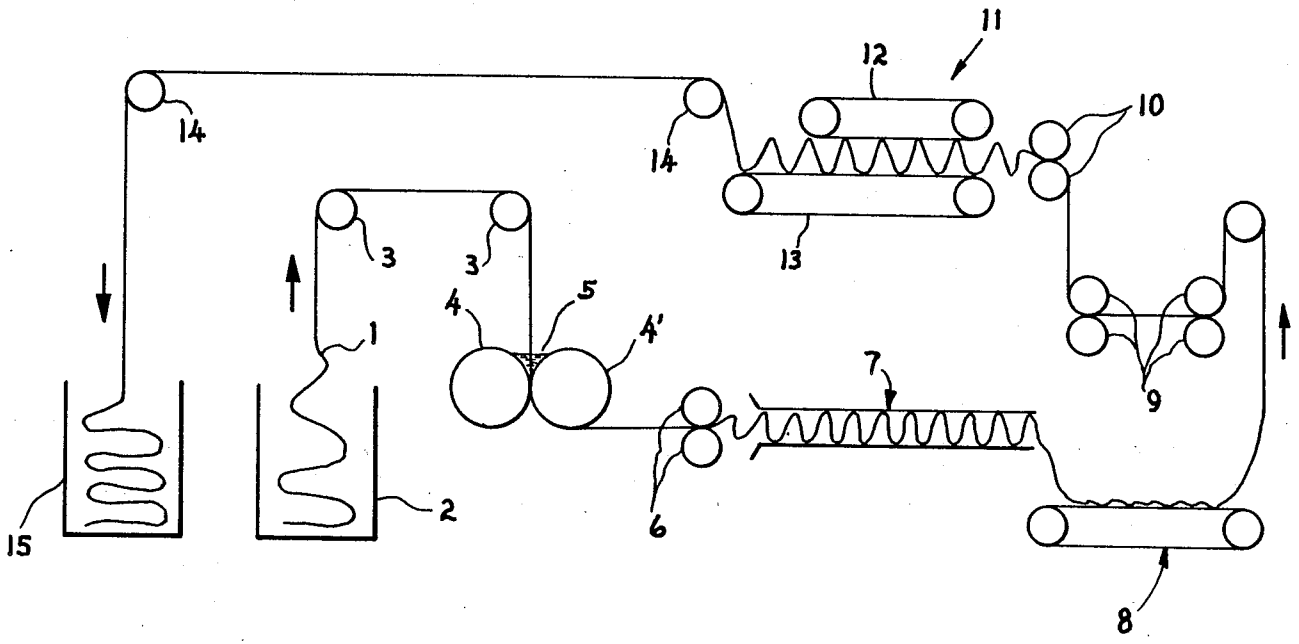
FIG. 1 is a schematic view of an apparatus, including a treatment chamber suitable for practicing the process of this invention.

This invention is an improved process for treating shrinkable materials, such as aromatic polyamide fibers.

More specifically, in the processes of this invention, a water-soluble material, and, if desired, a water-insoluble material are diffused or sublimed into a fiber structure of MPD-I amorphous synthetic fibers to improve their properties. During the diffusion and sublimation steps, the fibers are water-swollen or damp to the touch, with open pores. Steam controlled at critical temperatures in a chamber, is used to perfect the process.

Briefly, the fibers of this invention are prepared from aromatic polyamide polymers such as are disclosed in U.S. Pat. No. 3,063,966 to Kwolek, Morgan and Sorenson; U.S. Pat. No. 3,094,511 to Hill, Kwolek and Sweeny; and U.S. Pat. No. 3,287,324 to Sweeny, for example. These patents, and their teachings, are incorporated by reference into this application.

In preparing the basic water-swollen MPD-I fibers which are treated by the process of this invention, aromatic polyamides which have been prepared by procedures shown in the above-mentioned patents are combined with various solvents to form a spinning solution as shown, for example, in U.S. Pat. No. 3,063,966 and the fibers or filaments are formed by extruding the spinning solution through orifices in a spinneret. Such fibers may be dry-spun or wet-spun to form a water-swollen fiber structure. In either case, the fibers as spun are substantially amorphous.

The fibers whether dry-spun or wet-spun contain a substantial amount of solvent after having been solidified in a dry-spinning evaporation cell or coagulated in a wet-spinning precipitation bath. To remove the solvent such fibers are brought into contact with an aqueous extraction bath, as is known in the art. As a result the fibers become "water-swollen" with a water content of around 35% or more.

The above-described steps of forming amorphous water-swollen fibers of an aromatic polyamide polymer are known to the art and these fibers are all suitable for being further treated or processed in accordance with the process of this invention.

Specifically, in a preferred process, these water swollen fibers, which have not been dried, are contacted with an aqueous solution containing a water-soluble material and heated with steam at a temperature from about 110° C. to 140° C. for a time sufficient to diffuse substantially all of the water-soluble material into the pores of the fibers throughout such fiber structure. The material diffused into the fibers preferably is a dye. It may also be a surfactant.

In another preferred embodiment, when the material is dyed, the water-swollen, dye-containing fibers are then further heated with steam at a temperature above the glass transition temperature of the fibers for a time sufficient to collapse the pores and irreversibly lock the dye within the fibers and to crystallize such fibers and stabilize them against progressive laundry shrinkage. Temperatures in the range from 150° C. to 165° C. will accomplish these objectives.

In still another embodiment, never-dried, amorphous MPD-I fibers of the type described are contacted with an aqueous mixture containing both a water-soluble material, such as a dye, and an organic water-insoluble material which sublimes in steam at a temperature below the glass transition temperature of the fibers. The water-swollen fibers are then heated with steam at a temperature from about 110° C. to 140° C. for a time sufficient to diffuse substantially all of the water-soluble dye into the pores of such fibers and at a sublimation temperature below the glass transition temperature of the fibers to sublime the water-insoluble material into the open pores of such fibers. After the diffusion and sublimation steps have been completed, the fibers may be further heated with steam at a temperature above the glass transition temperature of the fibers for a time sufficient to collapse the pores and irreversibly lock the material within the fibers and to stabilize the fibers against progressive laundry shrinkage.

The term "fiber", as used herein, includes both staple fibers and continuous filaments. The continuous filaments may be in the form of a tow containing a large number of filaments or in the form of a yarn.

Referring specifically to FIG. 1 of the drawing, a fiber structure of never-dried, shrinkable fibers, as spun, in large bundles called tow, as indicated by the reference numeral 1, is supplied from a supply source 2 and passed over guide rolls 3 to nip rolls 4 and 4'.

An aqueous bath 5 of constant level is maintained at the entrance to the nip rolls. The tow 1 of moist to the touch fibers is brought into contact with the bath 5 which contains the material (e.g., a water-soluble dye, or surfactant, or ultraviolet light screener, for example) to be diffused or sublimed into the fibrous tow. The pick-up of material on the never-dried tow may be adjusted by suitably controlling the speed of the tow and the pressure applied between the nip rolls.

The tow 1 coated with the desired amount of material is then moved by feed rolls 6 into a treatment chamber 7, which is suitably an elongated tube having two or more treatment sections to which steam under appropriate pressure can be supplied, as will be explained in greater detail.

The tow is heated in these treatment sections at the required critical temperatures to diffuse the water-soluble material and to sublime the insoluble material into the fibers, after which such fibers may be further heated to stabilize the fiber structure against progressive laundry shrinkage.

The processed tow is then moved out of the chamber 7 and onto a conveyor 8, and then through squeeze rolls 9 to help remove water from the treated tow. The tow is then fed by feed rolls 10 into a dryer 11, which includes upper and lower conveyors 12 and 13 which move the tow at a speed which is adapted to form folds in the tow in the dryer. Such conveyors move the tow through the dryer 11 for a time sufficient to remove substantially all of the water from the tow. The dried and processed tow is then moved over transfer rolls 14 and into a storage container 15.

The treatment process will now be described in detail.

The tow 1 carrying the dye or other treatment material from the bath 5 is fed by feed rolls 6 at a first speed through an entrance opening 17 at one end of a funnel-shaped, fold-forming section 18 having converging walls 19 which define a discharge opening 20 at the other end of the section. If desired, the walls 19 can be straight and define a rectangular box-like section.

The tow is then moved through a restricted entrance opening 21 of the treatment chamber 7 defined by walls 22 and having a plurality of sections including a plug section 23 and first and second steam treatment sections 24 and 25. The chamber 7 is connected, preferably by a sharply tapered surface 22' to the discharge opening 20 of the fold-forming section 18 and the chamber entrance opening 21 is smaller than the entrance opening 17 of the fold-forming section 18. The dual action of the converging walls of the fold-forming section 18 and the tow 1 pushing through the restricted entrance opening 21 of the chamber 7 forms a plurality of folds in the tow. The chamber 7 further has a tow exit opening 26.

Steam in introduced into the second steam treatment section 25 which is positioned between the entrance and exit openings 21, 26 of the chamber 7. The steam flows in one direction into the second steam treatment section 25, then through this section and into the first steam treatment section 24, and from there into the plug section 23 and toward the entrance opening 17 of the fold-forming section 18 and in the other direction into and through the second steam treatment section 25 and toward the exit opening 26 of the chamber 7.

Figures 2, 2A, 3:
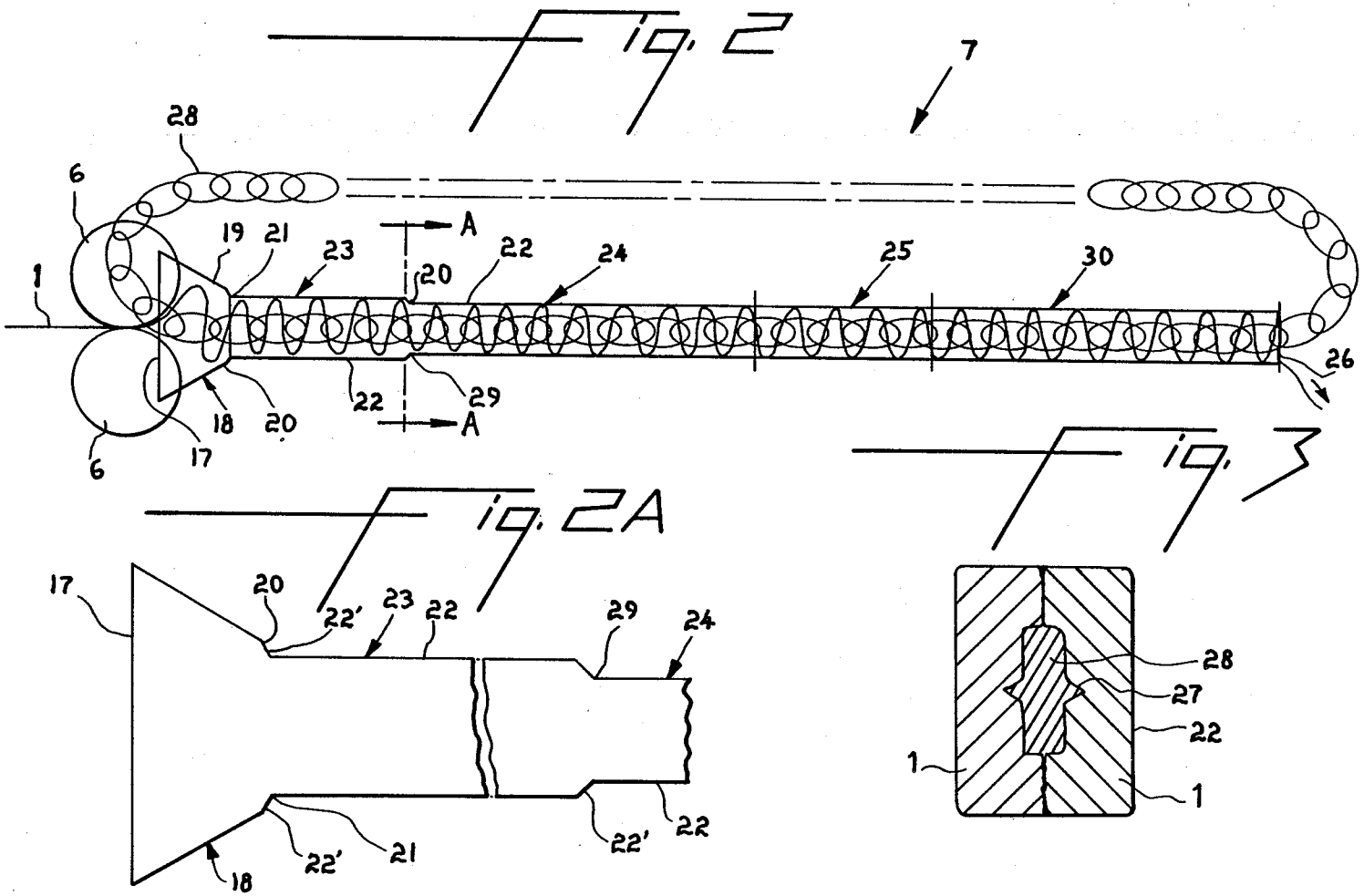
FIGS. 2 and 2A are schematic views showing the chamber in greater detail.
FIG. 3 is a cross-sectional view taken along lines A—A of FIG. 1, which highlights a significant feature of this invention, in showing the substantial contact of the tow with the walls defining the restricted opening of the treatment section of the chamber as it is moved through that opening.

As best seen in FIG. 3, the folds of the tow 1 are engaged by pins 27 on an endless chain 28 as the tow is moving in fold-forming section 18 and through the entrance opening 21 of the chamber 7. The chain 28 moves at a second speed slower than the first speed at which the tow is fed into the fold-forming section 18, by feed rolls 6. This variation of speeds will form the necessary folds in the tow in this section irrespective of the angle of the walls.

The tow is moved in folds through the plug section 23 at this second speed. In this section 23 the plurality of folds of the tow are in substantial contact with the walls of chamber 7 during a substantial portion of their movement through such section whereby to help substantially eliminate loss of steam through the entrance opening 17 of the fold-forming section 18. The steam flowing into this plug section 23 shrinks the tow so that it has a cross-sectional area smaller than that at which it entered the section. The tow is then moved from the plug section 23 and through a restricted entrance opening 29 of the first treatment section 24. The restricted entrance opening 29 is smaller than the restricted entrance opening 21 of the chamber 7. More than one plug section can be utilized, if desired.

The tow is moved through the first treatment section 24 at the second speed and the plurality of folds of the tow, as shrunken in the plug section 23, are substantially in contact with the walls defining the first treatment section 24 through much of their movement through such section whereby to further help prevent any loss of steam flowing through this section 24 and through the plug section 23 from escaping through the entrance opening 17 of the fold-forming section 18. This invention provides better control of steam temperatures in the critical treatment sections of the chamber.

The substantial contact of the folded tow with the walls of the chamber 7, pushing through the restricted entrance opening 21 of the plug section 23 and hence through the restricted opening 29 of the first treatment section 24, along with the contact of the folds with the walls 22 in these sections, substantially prevents escape of steam through the entrance opening of the chamber.

In this same connection, it frequently is desirable to wash the treated fibers in a wash section 30 of the chamber 7 prior to discharge of the tow from such chamber. The wash water along with the folded tow, further combine to substantially prevent loss of steam through the exit opening 26 of the chamber, as well.

By controlling loss of steam through the chamber openings, it is possible to maintain better control of the critical temperatures required in the first and second treatment sections, to effectively treat the fibers, as previously described.

The treatment of the tow in the manner just described provides MPD-I fibers having the improved properties sought in the treatment.

The following example will further illustrate this invention.

EXAMPLE

A. Preparation of Never-Dried Filaments of Poly(metaphenylene isophthalamide) (MPD-I).

Filaments of MPD-I having an inherent viscosity of 1.5 were dry spun from a filtered solution containing 19% MPD-I, 70% dimethylacetamide (DMac), 9% calcium chloride, and 2% water. On leaving the drying tower the as-spun filaments were given a preliminary wash with water so that they contained about 60% DMac, 15% calcium chloride, and 100–150% water, based on the weight of dry polymer. The filaments were washed and drawn 4× at 90° C. in a counter-current extraction-draw process in which the calcium chloride determined as chloride content and DMac content were reduced to about 0.1% and 0.5%, respectively. The wet filaments were gathered together to form a tow, a conventional antistatic finish was applied to the tow, and the tow was crimped in a stuffer box crimper at a temperature of about 80° C. in the presence of steam. The tow was then collected, still moist to the touch, in a plastic-lined cardboard box. The individual filaments had a linear density of about 1.55 decitex (dtex) (1.7 dpf). The linear density of the never-dried filaments here and elsewhere herein is based on the weight of dry filaments.

B. Dyeing and Shrinkage Stabilization of Tows of Never-Dried MPD-I Filaments in a Steam Chamber.

Two 120-kilotex (1,000,000 denier) tows of never-dried MPD-I filaments, prepared as described in Part (A) above, were creeled through the guides of a continuous tow dyeing apparatus equipped for high shrinkage tow. The tows were first fed between nip rolls at a rate of 14 m/min. wherein an aqueous dye solution was padded onto the tow so that the individual filaments in the tow were coated with the solution. The solution contained 40 g/l of C.I. (Colour Index) No. Basic Yellow 28 dye (a water-soluble dye), and 6 g/l of C.I. No. Basic Red 15 (a water-soluble dye), and 6 g/l cellulosic thickner and 58 g/l of anionic surfactant, adjusted to a pH of 7 (adding acetic acid or caustic soda as needed until the desired pH was obtained). The pick-up of the dye solution on the tow as 30 weight %.

After the tows were padded with the dye solution, they were then passed through the entrance funnel of a chamber, such as that shown in FIG. 2, the rectangular discharge end of the funnel having a width of 95 mm and a depth of 115 mm. Within the funnel the tows were turned and then gathered into folds as they were picked up by a chain moving at 1 m/min., one tow on each side of the chain. The tows, carried by the chain, were then passed into the entrance opening of a plug section of the chamber, which had a rectangular cross section 90 mm in width and 110 mm in depth, the discharge opening of the funnel and the entrance opening of the plug section being gently tapered into one another to avoid a stair step transition. The plug section was 3 m in length, and from it the tows were carried by the chain into a first treatment section, also 3 m in length, which had a rectangular cross section 88 mm in width and 107 mm in depth, the transition from the plug section to the first treatment section being gently tapered to avoid a stair-step transition. From the first treatment section the tows were then carried by the chain into a second treatment section 6 m in length wherein the tows of filaments coated with the solution were exposed to steam at a pressure of 609 kPa (six bars) and a temperature of 165° C. the steam being introduced into the chamber through holes in the walls of the chamber. The steam flowed from the second steam section back into the first treatment section and then into the plug section at progressively lower pressures and temperatures in the direction of the entrance funnel, the folds of the tow effectively sealing the entrance to the plug section so that substantially no steam flowed back into the entrance funnel. Within a zone beginning at about the end of the plug section and extending well into the first treatment section the filaments in the tows coated with the solution were exposed to steam at a temperature of about 120° C. for a contact time of about two minutes. The temperature of the tows at the end of the first treatment section, going into the second steam treatment section, was about 165° C. and remained at about 165° C. throughout the second treatment section. Upon leaving the treatment sections the tows were passed into a final wash section, wherein they were washed with water. The water and the wet tows acted together to condense the steam flowing from the second treatment section and formed an effective seal to prevent any steam from flowing from the exit end of the chamber.

After the tows were washed, they were fed into a forced air dryer, wherein their moisture level was reduced to 7% moisture. Finish was not added to the tow. The tows were dyed to a bright shade of orange. The shrinkage of the tows was measured and determined to be 0.9%.

In other experiments with similar tows using apparatus having a steam chamber of constant area, it was found to be difficult to maintain the steam at a pressure higher than about 203 kPa (two bars). The shrinkage of the tow when heated with steam at a pressure of only 203 kPa was 7%.

What is claimed is:

1. A process of treating a tow of shrinkable fibers including the steps of:
   - moving the tow in folds through a plug section operatively connected by a restricted opening to a treatment section, said plug section having an entrance opening larger than the restricted opening of the treatment section, and
   - heating the tow with steam in the treatment section
   - wherein sufficient steam migrates through the restricted opening from the treatment section to the plug section to cause shrinkage of the tow in the plug section, and
   - wherein the tow has a cross-sectional area substantially the same as the cross-sectional area of the entrance opening of the plug section as it moves through said opening and
   - wherein the tow has a smaller cross-sectional area as it leaves the plug section and moves through the entrance opening of the treatment section, due to shrinkage, and
   - wherein the cross-sectional area of the shrunken tow as it enters the smaller entrance opening of the treatment section is substantially the same as the cross-sectional area of this opening and
   - wherein the tow moving in folds in the plug section substantially prevents the loss of steam through the entrance opening of the plug section.

2. The process of claim 1 wherein the tow is an amorphous aromatic polyamide.

3. The process of claim 2 wherein the aromatic polyamide amide is poly(meta-phenylene isophthalamide).

4. The process of claim 2 wherein the aromatic polyamide amide has a second order glass transition temperature in steam of above about 150° C.

5. The method of claim 2 including the further step of:
   - padding a water-soluble dye onto the tow prior to the treatment and wherein the tow is heated with steam in such treatment section at a temperature of from about 110° C. to 140° C. for time sufficient to diffuse the dye into pores in the fibers the tow.

6. The process of claim 5 including the further step of:
   - moving the tow into a second treatment section wherein such tow is heated with steam at a temperature above its glass temperature from about 150° C. to 165° C. for a time sufficient to collapse the pores and lock the dye within the fibers and to crystallize such fibers and thereby stabilize the tow against progressive laundry shrinkage.

7. The process of claim 2 including the further steps of:

moving the tow through first and second treatment sections, contacting the fibers of the tow prior to the first treatment section with an aqueous mixture containing a water-soluble dye and an organic water-insoluble material which sublimes in steam at a temperature below the glass transition temperature of the fibers, heating the fibers with steam in the first treatment section at a temperature from about 110° C. to 140° C. for a time sufficient to diffuse substantially all of the water-soluble dye into the pores of such fibers throughout the fiber structure, heating the water-swollen fibers steam at a sublimation temperature below the glass transition temperature of the fibers for a time sufficient to sublime the water-insoluble material into the pores of such fibers throughout the fiber structure, and thereafter heating the water-swollen fibers steam in the second treatment section at a temperature above the glass transition temperature of the fibers for a time sufficient to collapse the pores and irreversibly lock the dye within the fibers and to stabilize the fibers against progressive laundry shrinkage.

8. The process of claim 7 wherein the fibers are heated with steam in the first treatment at a sublimation temperature of from about 110° C. to 150° C.

9. The process of claim 7 wherein the water-insoluble material is an ultraviolet light screener.

10. The process of claim 7 wherein the water-insoluble material is a disperse dye.

11. The process of claim 7 wherein the fibers are heated with steam in the second treatment at a temperature of about 165° C.

12. A process of treating a tow of shrinkable material including the steps of:

moving the tow at a first speed through an entrance opening at one end of a funnel-shaped, fold-forming section having converging walls which define a discharge opening at the other end of the section, said entrance opening being larger than the discharge opening;

moving the folded tow through a restricted entrance opening of a chamber defined by walls and having a plurality of sections including a plug section and first and second steam treatment sections, said chamber being connected to the discharge opening of the fold-forming section and said chamber entrance opening being smaller than the entrance opening of the fold-forming section, said chamber further having a tow exit opening wherein the dual action of the converging walls of the fold-forming section and the tow pushing through said restricted entrance opening of the chamber forms a plurality of folds in the tow, wherein steam is introduced into the second steam treatment section, which is positioned between the entrance and exit openings of the chamber, whereby such steam flows, in one direction into the second steam treatment section, then through this section and into the first steam treatment section, and from there into the plug section and toward the entrance opening of the fold-forming section and in the other direction into and through the second steam treatment section and toward the exit opening of the chamber, engaging the folds of the tow as it is moved in the fold-forming section and through the entrance opening of the chamber with pins on an endless chain moving at a second speed slower than the first speed moving the tow in folds through plug section at said second speed and wherein the plurality of folds of the tow are in substantial contact with the walls of chamber defining the plug section during a substantial portion of their movement the through this section whereby to help substantially eliminate loss of steam through the entrance opening of the fold-forming section and wherein the steam flowing into this plug section shrinks the tow so that it has a cross-sectional area smaller that at which it entered this section moving the tow in folds through a restricted entrance opening of the first treatment section, said entrance opening being smaller than the restricted entrance opening of the chamber moving the tow through the first treatment section at said second speed and wherein the plurality of folds of the two, as shrunken in the plug section, are substantially in contact with the walls defining the first treatment section through much of their movement through this section whereby to further help prevent any loss of steam flowing through this section and through the plug section from escaping through the entrance opening of the fold-forming section.

13. The process of claim 12 in which the chain engages two tows, one on each side, and moves them at said second speed through the chamber.

14. The process of claim 12 in which the restricted entrance opening of the chamber is connected to discharge opening of the fold-forming section by a tapered surface.

15. The process of claim 12 in which the restricted entrance opening of the first treatment section is connected to the plug section by a tapered surface.

16. An apparatus for treating a tow of shrinkable material including:

means for moving the tow at a first speed through an entrance opening of a fold-forming section, means for moving the folded tow through the fold-forming section and through a restricted entrance opening of a chamber defined by walls and having a plurality of sections including at least a plug section and a steam treatment section, said chamber further having a tow exit opening, means for engaging the folds of the tow at it is moved in the fold-forming section toward the entrance opening of the chamber with pins on an endless chain moving at a second speed slower than the first speed whereby to form a plurality of folds in the tow, means for introducing steam into the steam treatment section, which is positioned between the entrance and exit openings of the chamber, whereby such steam flows, in one direction through this section and into the plug section and toward the entrance opening of the fold-forming section and in the other direction into and through the steam treatment section and toward the exit opening of the chamber, means for moving the tow in folds through the plug section at the second speed and wherein the plurality of folds of the tow are in substantial contact with the walls of the chamber defining the plug section during a substantial portion of their movement through this section whereby to help substantially eliminate loss of steam through the entrance opening of the fold-forming section and wherein the steam flowing into this plug section shrinks the tow so that it has a cross-sectional area smaller than that at which it entered this section, means for moving the tow in folds through a restricted entrance opening of the treatment section, said entrance opening being smaller than the restricted entrance opening of the chamber and means for moving the tow through the treatment section at said second speed and wherein the plurality of folds of the tow, as shrunken in the plug section, are substantially in contact with the walls defining the treatment section through much of their movement through this section whereby further help prevent any loss of steam flowing through this section and through the plug section from escaping through the entrance opening of the fold-forming section.

17. A process of treating a tow of shrinkable fibers including the steps of:

moving the tow at a first speed through an entrance opening of a fold-forming section;

moving the folded tow through a restricted entrance opening of a chamber defined by walls and having a plurality of sections including a plug section and a steam treatment section, said chamber being connected to the fold-forming section and further having a tow exit opening, engaging the folds of the tow as it is moved in the fold-forming section and toward the entrance opening of the chamber with pins on an endless chain moving at a second speed slower than the first speed, wherein the dual action of the speed variation and the tow pushing through said restricted entrance opening of the chamber forms a plurality of folds in the tow, and wherein steam is introduced into the steam treatment section, which is positioned between the entrance and exit openings of the chamber, whereby such steam flows, in one direction into the steam treatment section, then through this section and into the plug section and toward the entrance opening of the fold-forming section and in the other direction into and through the steam treatment section and toward the exit opening of the chamber, moving the tow in folds through the plug section at said second speed and wherein the plurality of folds of the tow are in substantial contact with the walls of chamber defining the plug section during a substantial portion of their movement through this section whereby to help substantially eliminate loss of steam through the entrance opening of the fold-forming section and wherein the steam flowing into this plug section shrinks the tow so that it has a cross-sectional area smaller than that at which it entered this section, moving the tow in folds through a restricted entrance opening of the treatment section, said entrance opening being smaller than the restricted entrance opening of the chamber moving the tow through the first treatment section at said second speed and wherein the plurality of folds of the tow, as shrunken in the plug section, are substantially in contact with the walls defining the treatment section through much of their movement through this section whereby to further help prevent any loss of steam flowing through this section and through the plug section from escaping through the entrance opening of the fold-forming section.

18. The process of claim 17 in which the chain engages two tows, one on each side, and moves them at said second speed through the chamber.

19. The process of claim 17 wherein the tow is moved through a chamber defined by slanting walls which match the profile of the shrunken tow as it moves through such chamber and wherein the tow is of shrinkable aromatic polyamide fibers.

* * * * *